US006561287B2

(12) United States Patent
DeBlasio

(10) Patent No.: US 6,561,287 B2
(45) Date of Patent: May 13, 2003

(54) METHOD AND APPARATUS FOR SAWING OR DRILLING CONCRETE

(76) Inventor: Michael J. DeBlasio, 409 King St., Littleton, MA (US) 01460

( * ) Notice: Subject to any disclaimer, the term of this patent is extended or adjusted under 35 U.S.C. 154(b) by 24 days.

(21) Appl. No.: 09/834,314

(22) Filed: Apr. 13, 2001

(65) Prior Publication Data

US 2002/0148651 A1 Oct. 17, 2002

(51) Int. Cl.[7] ..... E21B 21/00
(52) U.S. Cl. ..... 175/65; 175/106; 175/107
(58) Field of Search ..... 175/57, 65, 92, 175/105–107, 403, 405.1

(56) References Cited

U.S. PATENT DOCUMENTS

| | | | | |
|---|---|---|---|---|
| 4,321,938 | A | | 3/1982 | Siller |
| 4,392,508 | A | | 7/1983 | Switall |
| 4,765,415 | A | | 8/1988 | Khalafalla et al. |
| 4,870,946 | A | | 10/1989 | Long et al. |
| 4,911,253 | A | * | 3/1990 | Cliche |
| 4,959,164 | A | | 9/1990 | Engelmann et al. |
| 5,004,382 | A | * | 4/1991 | Yoshino |
| 5,055,008 | A | | 10/1991 | Daniels et al. |
| 5,196,401 | A | | 3/1993 | Engelmann et al. |
| 5,613,835 | A | * | 3/1997 | Tyner |
| 5,660,240 | A | * | 8/1997 | Harms et al. |
| 5,807,810 | A | | 9/1998 | Blezard et al. |
| 5,951,265 | A | | 9/1999 | Bryant |
| 6,000,387 | A | | 12/1999 | Lee |
| 6,050,163 | A | | 4/2000 | Gravely |

OTHER PUBLICATIONS

Furbush, Todd et al., ; Class Notes; Concrete Openings; Jun. 2001, p. No. 44.
Chemilizer Products, Inc.; 5 pages.
Partner Industrial Products; 19 pages.

* cited by examiner

*Primary Examiner*—Roger Schoeppel
(74) *Attorney, Agent, or Firm*—Pandiscio & Pandiscio

(57) ABSTRACT

An improved method and apparatus for sawing or drilling concrete or like material comprises use of a water-powered pump for introducing a metered amount of a speed-enhancing compound into a stream of water as the water is applied to a masonry saw or core drill during a sawing or drilling operation.

15 Claims, 2 Drawing Sheets

METHOD AND APPARATUS FOR SAWING OR DRILLING CONCRETE

Figure 1:
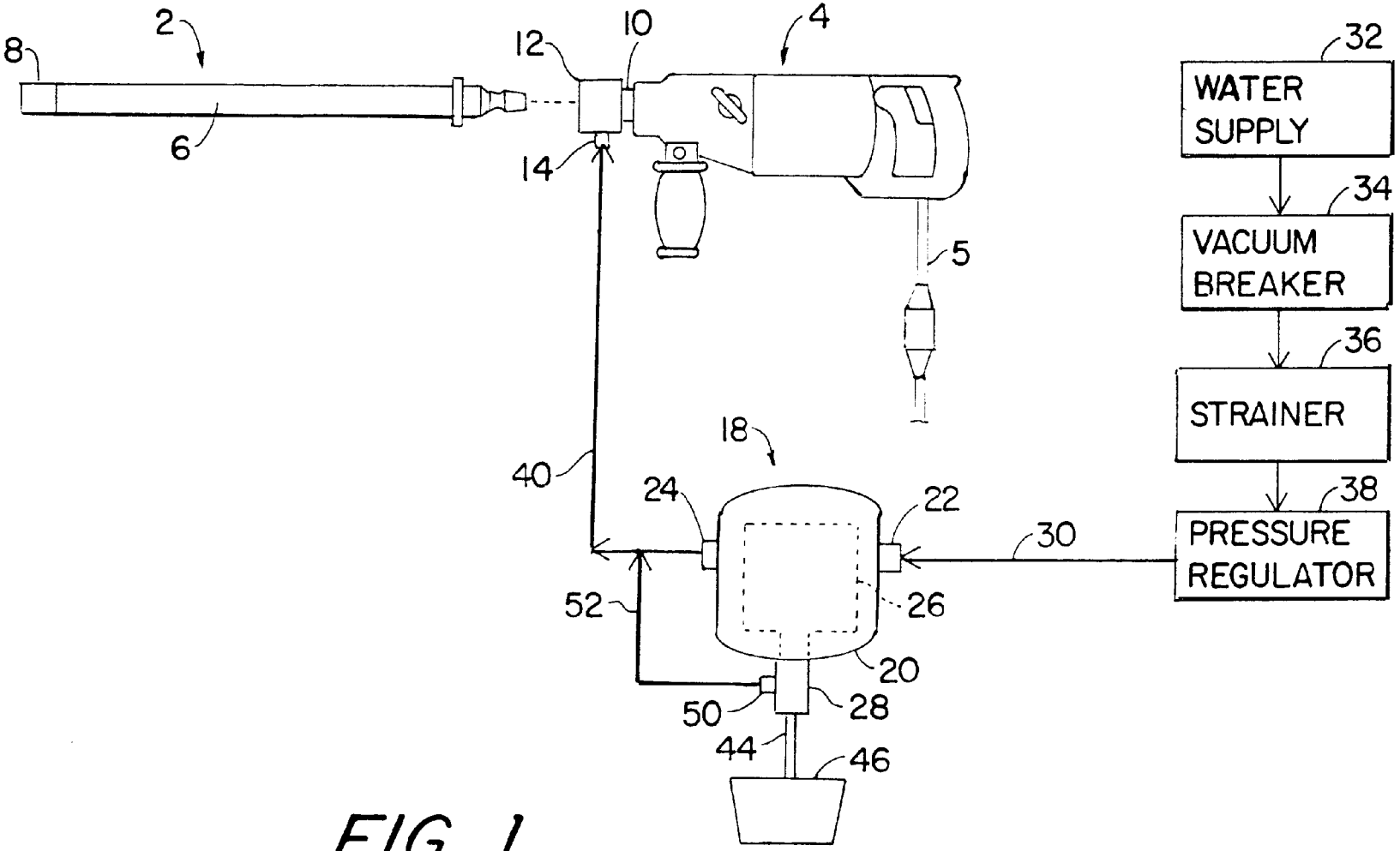

This invention relates to saws and core drills used in cutting and drilling holes in hard masonry materials, and more particularly to provision and use of means coupled to a masonry saw or core drill for facilitating the cutting or drilling of concrete or other hard masonry materials.

BACKGROUND OF THE INVENTION

As used herein the term "masonry material" means and includes concrete, steel-reinforced concrete, various kinds of rock including but not limited to granite, sandstone, fired brick, and tile. Special saws and drills are used for cutting and drilling those materials. Masonry saws take various forms, including rotary blade saws, ring saws, and chain saws. The drilling of lengthy holes, e.g., holes 10–20 inches long, in structures or structural components made of a hard masonry material is commonly accomplished with a core drill (also called "core drill bit") attached to a manually operated driver. A core drill commonly comprises an elongate hollow tubular member, one end of which is adapted to be releasably secured to the rotatable output shaft of a driver which typically is an electrically-powered or pneumatically-powered device. The opposite end of the tubular member is in the form of or carries a tubular cutting head that may comprise diamond or carbide particles embedded in a metal matrix. The core drill derives its name from the fact that as it drills into concrete or other dense material the interior of the drill fills with a discrete cylinder, called a "core", composed of particles of the material that is being drilled.

A common practice is to apply water to masonry saws and core drills to enhance cutting and drilling. When water is applied to saws, the sawing process is identified as "wet sawing". The water is applied as a spray or jet(s) so as to flow over at least the cutting edge portion(s) of the saw device, e.g., the teeth of a chain saw or of a rotary saw blade. In the case of wet core drilling, the water is injected into the core drill. Injection of water into a core drill is accomplished by means of a coupling device that either is a component of the driver or is a separate component that may be detached when it is desired to perform dry core drilling.

The water may be supplied to a masonry saw and core drill via a hose line connected to a remote water supply, e.g., a municipal water supply. However, for certain applications, e.g., where the sawing does not require a large supply of water or when a limited number of holes are to be drilled, a portable water supply, e.g., a pressurized ten-gallon tank of water, may be coupled to the saw or core drill.

Applying water aids the sawing process by cooling the cutting portion(s) of the saw device and removing saw residue from the work area. Similarly, injecting water into the core drill aids the drilling process by (1) cooling the drill, (2) facilitating movement away from the cutting head of the particles produced by the drilling operation so as to avoid unnecessary regrinding of those particles, and (3) reducing masonry dust in the work area. Consequently wet coring is preferred for renovation work in inhabited buildings where it is necessary to maintain a dust free environment. In such case it is common to surround the core drill with a water collector that serves to collect water, including suspended masonry particles, that escapes from the hole being drilled in the masonry. In core drilling of concrete, water may be supplied at a rate of as much as about 1 gallon per minute, whereas in wet sawing the water may be supplied at a rate as high as about 4 gallons per minute.

The speed at which cutting and drilling proceeds in concrete and other hard masonry materials is a function of the hardness of the material being cut or drilled. The harder the material, the lower the cutting or drilling speed, i.e., the rate of penetration of the material by the saw or drill head. It is recognized that increasing the cutting and drilling rates in concrete and other like structural materials is desirable, if it can accomplished at reasonable cost. Prior to the invention it was known that the cutting of concrete may be enhanced by applying an aqueous solution of one or more selected compounds to the cutting tool as it was cutting. See, for example, U.S. Pat. No. 5,196,401. However, there has existed a need for a practical, dependable and relatively inexpensive way of supplying a masonry saw or core drill with cooling water containing a measured amount of a cutting speed-enhancing compound.

SUMMARY OF THE INVENTION

The invention stems from the desire to improved the speed at which masonry saws and core drill cut or drill into structures or structural components made of masonry materials in the form of concrete, steel reinforced concrete, granite, sandstone, fired brick or like masonry material and consists of a novel method and apparatus for providing a stream of cooling water containing a cutting speed-enhancing composition. As used herein, the term "cutting speed" identifies the rate, in terms of units of depth per unit of time, at which a saw cuts through, or a core drill penetrates, a masonry material. More specifically, the invention involves use of a water-powered proportioning pump (also known as a "dosing pump") to introduce a metered amount of a speed-enhancing compound into a stream of cooling water as it is being applied to a masonry saw or core drill. In a first embodiment of the invention, a water-powered proportioning pump is connected in a pipe or hose line connecting a water supply to a core drill that is attached to an electrically or pneumatically powered driver, and a liquid speedenhancing surfactant-containing composition is injected into the water line by the proportioning pump. In a second embodiment of the invention, a waterpowered proportioning pump is connected in a pipe or hose line connecting a water supply to a masonry saw, and a speed-enhancing composition is injected into the water line by the proportioning pump. The method and apparatus of the invention provides that the speed-enhancing composition is injected into the water line in a measured rate, and also the speed-enhancing composition is deliver only on a demand basis.

Other objects, features and advantages of the invention are described or rendered obvious by the following detailed description which is to be considered together with the drawings identified below.

The Drawings

Figure 2:
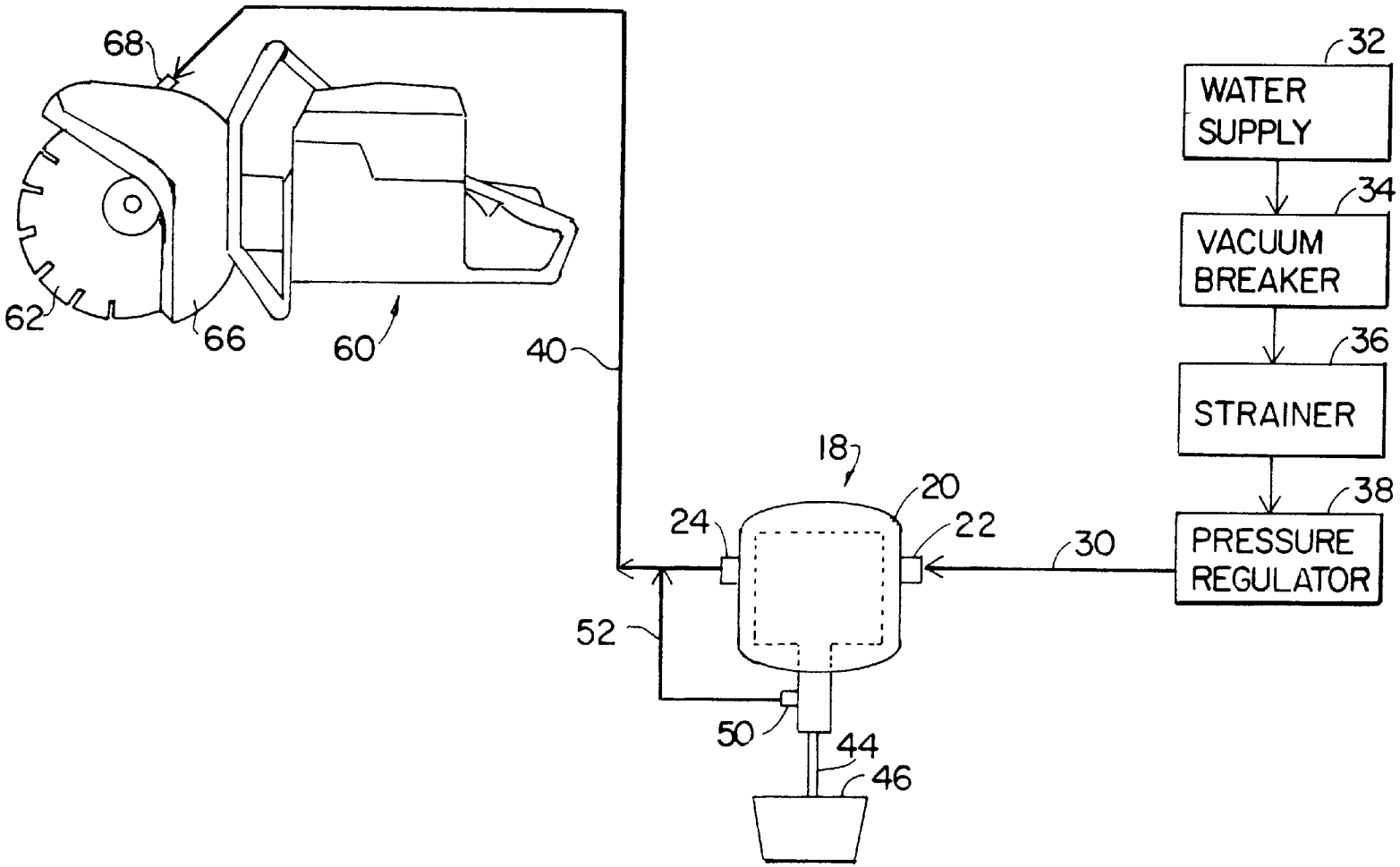

FIG. 1 is a schematic view of a core drill system embodying the present invention; and FIG. 2 is a schematic view of a saw system embodying the present invention.

Like components are identified by like numerals in the drawings.

DETAILED DESCRIPTION OF THE INVENTION

FIG. 1 shows a conventional core drill bit 2 and a conventional electrically-powered heavy duty driver 4 for driving the drill bit. The latter is shown in exploded relation to the driver for convenience of illustration and description. The driver is shown as having a power cord 5 for coupling it to an electrical power source. The illustrated core drill bit 2 comprises an elongate hollow cylindrical barrel 6 having a hollow cylindrical drill head 8 at its forward end. Typically the drill head 8 comprises diamond or silicon carbide particles embedded in a strong metal matrix. Core drill bit 2 may take other forms without affecting the invention. They are available commercially from a number of companies. One such company is Hilti, a corporation have a place of business at 12330 E. 60th Street South, Tulsa, Okla. 74121.

The output end of the driver includes a chuck 10 which is adapted to receive and releasably lock the core drill bit to the driver. The design and construction of the driver is not critical to this invention. Various forms of core drill drivers are available commercially from a number of companies, including Hilti (supra) and Flex Porter-Cable, a company having a place of business at 4825 Highway 45 North, Jackson, Tenn. 38305.

A water intake device 12 is interposed between core drill bit 2 and chuck 10. The water intake device 12 is designed to inject water into the interior of the core drill as it is rotated to execute a drilling operation. For this purpose water intake device 12 has an inlet port 14 whereby water can be delivered from a source of supply into water intake device 12 and from there into the core drill bit during a drilling operation. Water intake device 12 may be a separate component that can be removed when it is desired to perform dry core drilling; alternatively it may be built as an integral part of the chuck assembly. Thus, for example, the water intake device may take the form of the water swivel attachment sold by Hilti under the designation "Hilti DD 100 ⅝" Water Swivel" which is adapted for use with the Hilti DD-100 Drill (i.e., driver). The Hilti water swivel functions to rotatively connect a core drill to the driver's chuck and also to inject water into the core drill bit. Alternatively, and further by way of example, the driver 4 and water intake device 12 may take the form of the Flex PorterCable Model BHW 812 V V electrically-powered driver which has a built-in water intake. Whether the water intake device is a separate component or is an integral part of the driver is not critical to the invention, and the water intake device may take various forms so long as it satisfies the requirement of providing means for directing water into the core drill bit as the latter is driven by the driver into concrete or other masonry material.

The system of FIG. 1 further includes the use of a water-powered dosing device identified generally by the numeral 18. Water-powered dosing devices are also known as proportioning pumps. The dosing device may take various forms. However, in general they comprise a water motor having a main housing with inlet and outlet ports for passing a stream of water through the housing and a drive mechanism contained in the main housing that is adapted to be driven by the water flowing through the housing, and an injection pump connected to and driven by the drive mechanism of the water motor for removing a selected additive from its supply and injecting the same into the stream of water that drives the drive mechanism. The injection pump may be contained within the main housing; alternatively it may be wholly or partly outside of the main housing, but still operatively connected to the drive mechanism. Accordingly in FIG. 1, the proportioning pump 18 is shown as comprising a water motor that includes a housing 20 having inlet and outlet ports 22 and 24 respectively and containing a fluid-driven drive mechanism represented schematically at 26 which is connected to and serves to operate an injection pump, represented schematically at 28, in response to the driving force of a stream of water introduced at inlet port 22 and exiting via outlet port 24. Inlet port 22 is connected via a conduit 30 to a domestic water supply 32. As used herein, the term "domestic water supply" is intended to include municipal and non-municipal water sources, including commercially or privately owned wells, that are capable of providing a continuous flow of water under a suitable near constant or regulated pressure.

Although port 22 may be connected directly to the water supply 32, it is preferred that a vacuum breaker 34, a strainer or filter 36 and a pressure regulator 38 be interposed in conduit 30 between the water supply and port 22. The vacuum breaker 34 is for the purpose of preventing backflow of water from the pump to the water supply. The strainer 36 is to intercept any particulate matter in the water flowing in conduit 30, e.g., dirt particles, that might adversely affect operation of pump 18. The purpose of pressure regulator 38 is to keep the water pressure below a predetermined maximum limit to assure proper operation of pump 18, e.g., within the maximum limit prescribed or recommended by the manufacturer of the proportioning pump. By way of example but not limitation, in the case where the water supply pressure is about 125 psi, regulator 38 may be designed or set so as to limit the water pressure applied to pump 18 to a maximum of 80 psi.

Outlet port 24 is connected to inlet port 14 of water intake-device 12 via a conduit represented schematically at 40. Preferably conduit 406 is flexible hose line. The injection pump has an inlet port which communicates via a conduit 44 with a supply of an additive solution comprising a selected speed-enhancing surfactant compound (additive) which is contained in a suitable supply vessel or tank 46. The injection pump also has an outlet port 50 which is connected via an additive solution feed line 52 to the conduit 40 that connects outlet port 24 of the proportioning pump with port 14 of water intake device 12.

Details of construction of the water motor, including its fluid-driven drive mechanism 26, and the injection pump 28 are not set forth herein since various forms of proportioning pumps may be used in practicing the invention provided that they are driven by the water or other cooling fluid that is applied to the core drill bit. Commercial proportioning pumps commonly comprise a piston-type injection pump for accurate metering, a water motor having a fluid-driven drive mechanism that commonly comprises a drive piston sealingly mounted for reciprocating movement in response to flow of water through the water motor housing, and means for translating movement of the drive piston into operation of the injection pump. More specifically and by way of example, the fluid -powered dosing device (proportioning pump) 18 may be like any of the devices described in the following U.S. patents: U.S. Pat. No. 5,234,322, issued Aug. 10, 1993 to R. Daniels et al.; U.S. Pat. No. 5,055,008, issued Oct. 8, 1991 to R. Daniels et al.; U.S. Pat. No. 5,951,265, issued Sep. 14, 1999 to D.C. Bryant; and U.S. Pat. No. 4,321,938, issued Mar. 30, 1982 to R. Siller. For the purposes of this invention, the disclosures of the foregoing U.S. Pat. Nos. 5,234,322, 5,196,401, 5,951,265, and 5,055,008 are incorporated herein by reference thereto. Further, by way of example, pump 18 may comprise a Chemilizer water motor combined with a Chemilizer chemical injection pump, as offered for sale by Chemilizer Products, Inc. of 12745 49th Street North, Clearwater, Fla. 33762.

Operation of the system shown in FIG. 1 is straightforward. When water under pressure flows from supply 32 through the housing 20, the force of the flowing water causes operation of water motor drive mechanism 26, and the latter in turn drives the injection pump whereby the latter removes additive solution from supply vessel 46 in controlled dosages and injects it via conduit 52 into the water stream flowing from housing 20 via conduit 40 to water intake device 12. The injection pump 28 is operated only so long as water is flowing through housing 20 of pump 18 at a rate sufficient to operate drive mechanism 26.

The advantage of using a dosing device (proportioning pump) of the character described is that they are capable of injecting small amounts of additive solution into a stream of water. By way of example, the Chemilizer water motor/injection pump apparatus is adapted to accommodate water flow in the range of 1–700 gallons per hour at pressures ranging from 2–80 psi, and the injection pump is capable of injecting an additive solution into the water stream flowing through the water motor in a ratio of 1 gallon of additive solution per 100 gallons of water flowing through the apparatus. However, by appropriately diluting the additive solution it is possible limit the concentration of speedenhancing compound injected into the flowing water stream to within, for example, the range of 1–15 parts per million. Of course, if desired, the rate of introduction of additive into the cooling water fed to the core drill may be increased so as to produce a concentration in the cooling water stream in excess of 15 parts per million. Preferably such an increase is effected by changing the concentration of additive in the solution contained in supply vessel 40, since the rate of flow of water through the water motor will be essentially constant using a domestic water supply as the source of cooling water.

FIG. 2 illustrates a modification of the invention. In this case a motorized saw 60 replaces core drill bit 2, driver 4 and water intake device 12. The rotary blade 62 of saw 60 is provided with a protective blade guard or shroud 66 that covers a portion of the blade. The shroud 66 has a port 68 therein which is connected by the conduit 40 to the outlet port 24 of the proportioning pump 18. As with the embodiment of FIG. 1, the proportioning pump serves to deliver cooling water to the saw, with the cooling water being dosed with a metered amount of a selected surfactant or other additive as described above. Although not shown, it is to be understood that in the case of chain and ring saws, the invention contemplates those tools being fitted with a water discharge nozzle that is directed at the cutting teeth of the chain or ring saw and is connected to line 40, whereby cooling water dosed with a metered amount of a selected surfactant is applied to a cutting teeth of those tools as they are used to cut concrete or other masonry material.

It has been determined that addition of a surfactant to the cooling water for a core drill or a concrete saw can provide a substantial increase in the speed at which such tools penetrate concrete, and also in reduced wear of the cutting elements of the tool. Accordingly the liquid additive supplied by operation of the proportioning device comprises one or more surfactants. The invention is not limited to particular surfactants, and the surfactants may be anionic or cationic materials. Surfactants like those used in household and industrial detergent compositions may be used with the invention to improve drilling and cutting speeds. Examples of anionic surfactants that are useful with the invention are alkyl benzyl sulfonate, alkyl sulfates derivatives of coconut oil and tallow, sodium dodecyl sulfate, and alkyl ether sulfate. An example of a suitable cationic surfactant is trimethyidodecyl ammonium chloride. Still other cationic surfactants are known to persons skilled in the art. Preferably the surfactant is a non-ionic polymer capable of hydrogen bonding with water to produce chargeneutralizing positive charge dipoles, e.g., a polyalkylene oxide such as polyethylene oxide and a polyacrylamide-based non-ionic polymer is preferred. The use of such non-ionic polymers in relation to cutting or drilling rock or concrete, and the resultant benefits of increased cutting speed and reduced cutting element wear, is discussed in detail in U.S. Pat. No. 5,196,401, issued Mar. 23, 1993 to W. H. Engelmann et al. The minimum concentration of such polymer in the aqueous solution injected into core drill 2 should be about 1–3 parts per million. That concentration is easily accomplished with a proportioning pump of the type described. Still other surfactants that may be used in drilling or cutting concrete or like material according to the invention are disclosed by U.S. Pat. No. 5,807,810, issued Sep. 15, 1998 to M. Blezard et al. The teachings of U.S. Pat. Nos. 5,196,401 and 5,807,810 regarding use of surfactants for cutting materials like concrete and rock are incorporated herein by reference.

The advantages of the invention, include the fact that the additive is supplied to the drilling operation only when water is flowing to the drill or saw device. Consequently, and particularly considering the relative high cost of certain surfactants, the use of the surfactant is controlled. A further advantage is that the invention does not require the use of electrical power or pneumatic connections in addition to the electrical or pneumatic connections required for the core drill driver 2 or for the saw device. Also the ability to control the dosage of the additive is advantageous not only from the standpoint of enhancing the cutting speed, but also from an economical basis, since particularly in using saws to cut concrete walls or floors, the consumption of water may be quite high, in the order of 5 gallons per minute. Consequently, controlling the flow of additives into the line 16 is important.

Obviously the invention may be practiced otherwise than as described above and illustrated in FIGS. 1 and 2. Thus the invention may utilize different forms of core drills and drivers. Similarly, although saw 60 is represented as a rotary blade saw, it is to be understood that the invention may be practiced with other types of saws for cutting concrete, notably ring saws and chain saws. Also pneumatically powered tools may be used in place of electrically powered tools. The invention is not limited in its application to saws employed at construction work sites, but also extends to saws used in quarries and various stone work shops.

In the preferred mode of practicing the invention, the portion of conduit 30 connecting inlet port 22 to pressure regulator 38 is a flexible hose line having a length sufficient to allow pump and additive storage vessel 46 to be located close to the work site, thereby facilitating use of the system. A valve (not shown) may introduced into conduit 40 so as to enable the operator to terminate the flow of water to the core drill or the saw device, and simultaneously terminate operation of the dosing device 18. Alternatively, but not preferred, the valve could be located on the upstream side of pump 18. The significant thing is that no additional electrical or pneumatic connections are required in order to achieve controlled dosing of the cooling water stream.

It is to be noted also that the invention is not limited to supplying cooling water. Instead, for example, the cooling medium supplied to the proportioning pump 18 could be a light oil, with the proportion of speed-enhancing surfactant compound and the selection of speed-enhancing compound being adjusted according to whether oil or water is being used as the cooling medium.

As used herein, the term "water motor" is synonymous with the terms "water-powered motor" and "water engine"

which are also used to denote a device characterized by an operating drive mechanism that is powered by a flowing stream of water. Also the term "conduit" as used herein shall mean and include, where the context so admits, a hose, tubing or pipe. Preferably as indicated above, the conduit 40 is a flexible hose so as not to hinder maneuvering of driver 4 or saw 60. The term "cutting device" as used in the claims in intended to embrace and include core drills and saws and, where the context so admits the drivers for such cutting devices. The cutting elements of a saw are its cutting teeth, and the cutting elements of a core drill are the teeth of and/or the diamond or silicon carbide particles carried by the cutting head of the drill.

Still other modifications and variations of the invention will be obvious to persons skilled in the art from the foregoing description and the FIGS. 1 and 2.

What is claimed is:

1. A method for improving the rate at which a portable cutting device drills or cuts a selected material from the group consisting of concrete, granite, sandstone, or fired brick, said cutting device comprising a tool having cutting elements for cutting or drilling said selected materials and a powered driver for driving said tool, said method comprising the following steps:

(A) providing a water-powered pump comprising (1) a water-powered motor having a flow-through passageway, and inlet and outlet ports communicating with said passageway, and (2) an injection pump connected to and driven by said water-powered motor, said injection pump having inlet and outlet ports and being adapted to pump a liquid introduced at its said inlet port to its said outlet port at a rate that is a function of the rate at which water flows in said flow-through passageway;

(B) coupling said water-powered pump to said cutting device by (a) connecting said inlet port of said water-powered motor to a source of water under pressure via a first conduit, (b) connecting said outlet port of said water-powered motor to said cutting device via a second conduit so that water discharged from said outlet port of said water-powered motor will wet said tool, (c) connecting said inlet port of said injection pump to a supply of a liquid additive that enhances the cutting or drilling performance of said tool, and (d) connecting said outlet port of said injection pump via a third conduit to said second conduit; and (C) while said cutting device is being operated and engaged in cutting or drilling said selected material, operating said water-powered pump by passing a stream of water under pressure from said source through said passageway via said inlet and outlet ports of said water-powered motor, so that simultaneously (1) said stream of water will be delivered to said cutting device and (2) a limited quantity of said liquid additive will be injected by said injection pump into said second conduit via said third conduit, whereby the cutting or drilling of said selected material by said tool is enhanced by the presence of said additive in said stream of water.

2. A method according to claim 1 wherein said liquid additive is a solution of a surfactant.

3. A method according to claim 2 wherein said surfactant is an anionic compound.

4. A method according to claim 2 wherein said surfactant is cationic compound.

5. A method according to claim 1 wherein said liquid additive comprises a polyalkylene oxide or a polyacrylamide-based non-ionic polymer.

6. A method according to claim 1 wherein said driver is a fluid-powered driver.

7. In combination with a powered cutting device comprising a tool having cutting elements for drilling or cutting a selected masonry material in the form of concrete, granite, sandstone, or fired brick and a powered driver for driving said tool, apparatus for use in supplying to said tool a stream of water that includes a liquid additive that enhances the rate at which said tool drills or cuts said masonry material comprising:

a water-powered motor having a water flow-through passageway, and inlet and outlet ports communicating with said passageway, said inlet port being adapted to be connected by a conduit to a supply of water under pressure and said outlet port being connected by a conduit to said powered cutting device so that water discharged from said outlet port will wet said tool;

an injection pump connected to and operable by said water-powered motor, said injection pump having inlet and outlet ports and being adapted to pump a liquid additive introduced at its inlet port to its said outlet port at a rate that is a function of the rate at which water flows in said flow-through passageway;

means for connecting said inlet port of said injection pump to a supply of a liquid additive; and conduit means connecting the outlet port of said injection pump to the said conduit that connects said outlet port of said water motor to said powered cutting device, whereby if said inlet port of said injection pump is connected to a supply of a liquid additive and said water powered motor is operated by a stream of water passing through said passageway while said powered cutting device is engaged in cutting or drilling a masonry material, said stream of water will be delivered to said tool and simultaneously said injection pump will operate to inject a metered quantity of said liquid additive into the water stream flowing from said water-powered motor to said powered cutting device.

8. Apparatus according to claim 7 wherein said driver is a fluid-powered driver.

9. Apparatus according to claim 7 wherein said tool is a core drill.

10. Apparatus according to claim 7 wherein said tool is a saw.

11. Apparatus for drilling or cutting a masonry material comprising:

a powered cutting device for drilling or cutting a selected masonry material in the form of concrete, granite, sandstone, or fired brick, said powered cutting device comprising masonry cutting means and a powered driver for driving said masonry cutting means; and fluid delivery means for use in supplying to said powered cutting device a liquid that enhances the rate at which said powered cutting device drills or cuts said masonry material, said fluid delivery means comprising a water-powered motor that includes a chamber and inlet and outlet ports communicating with said chamber whereby water may be introduced to and discharged from said chamber, said inlet port being adapted for connection to a supply of pressurized water, water-directing means including a conduit connected to said outlet port of said water-powered motor for directing a stream of water from said outlet port onto said masonry cutting means of said powered cutting device, an injection pump connected to and operated by said water-powered motor, said injection pump having an inlet port that is adapted for connection to a supply of a liquid additive that is intended to enhance the performance of said masonry cutting means and an outlet port connected to said conduit of said water-directing means, said injection pump being adapted to inject a metered amount of said liquid additive into a water stream delivered to said water-directing means via said outlet port of said water-powered motor.

12. Apparatus according to claim 11 wherein said masonry cutting means is a drill.

13. Apparatus according to claim 11 wherein said masonry cutting means is a saw.

14. Apparatus according to claim 13 wherein said masonry cutting means is a chain saw or a rotary saw.

15. Apparatus according to claim 11 wherein said powered driver is a pneumatic driver.

* * * * *